US005411340A

United States Patent [19]

Elgee

[11] Patent Number: 5,411,340

[45] Date of Patent: May 2, 1995

[54] "MILEPOST" SINGLE-CHANNEL ENCODER, SCALE, AND METHOD, FOR MIDSCAN TURN AROUND IN A SCANNING-HEAD PRINTER OR READER

[75] Inventor: Steven B. Elgee, Portland, Oreg.

[73] Assignee: Hewlett-Packard Company, Palo Alto, Calif.

[21] Appl. No.: 122,833

[22] Filed: Sep. 17, 1993

[51] Int. Cl.[6] ..... B41J 21/14; B41J 19/30

[52] U.S. Cl. ..... 400/279; 400/322

[58] Field of Search ..... 358/481, 409, 413, 488, 358/494; 346/29; 395/103, 105; 347/37, 39, 38; 400/279, 322

[56] References Cited

U.S. PATENT DOCUMENTS

| | | | |
|---|---|---|---|
| 3,681,773 | 8/1972 | Russell | 346/29 |
| 4,779,348 | 10/1988 | Levy | 346/29 |
| 4,789,874 | 12/1988 | Majette | 346/140 |
| 5,276,970 | 1/1994 | Wilcox | 33/18.1 |

FOREIGN PATENT DOCUMENTS

| | | | |
|---|---|---|---|
| 0500116 | 8/1992 | European Pat. Off. | 400/279 |

*Primary Examiner*—Edward L. Coles, Sr.
*Assistant Examiner*—John Ning

[57] ABSTRACT

The encoder scale has features to be automatically read by a single-channel sensor of the device to determine position of a carriage that is part of the device and moves bidirectionally across the sheet. These features include a first group of many graduations formed in a single row along the substrate; and a second group of many graduations also formed in the same row along the substrate and interspersed among those of the first group over at least a distance that corresponds approximately to the full transverse dimension of the sheet. The scale also includes some provision for automatically distinguishing —by the single-channel sensor of the image-related device—between graduations of the first and second groups. This provision includes, for each graduation of the second group, some feature (such as width) that is distinctive in relation to the graduations of the first group. The invention also provides the image-related device, with the carriage operating bidirectionally to print or read image details onto or from the sheet, and with the encoder scale incorporated as well as a single-sensor subsystem for detecting the individual graduations of both sets—and also including a single-channel subsystem that makes use of the two groups of graduations for two distinct purposes, respectively.

20 Claims, 6 Drawing Sheets

"MILEPOST" SINGLE-CHANNEL ENCODER, SCALE, AND METHOD, FOR MIDSCAN TURN AROUND IN A SCANNING-HEAD PRINTER OR READER

BACKGROUND

1. Field of the Invention

This invention relates generally to machines and procedures for printing or reading images—text or graphics—on an image-bearing sheet; and more particularly to single-channel position encoding for a scanning-head thermal-inkier printing machine and method that construct images from individual ink spots created on such a sheet, in a two-dimensional pixel array.

In the case of a machine for printing, the sheet is ordinarily of some printing medium such as paper, transparency stock, or other glossy medium.

Image-reading machines of the sort under discussion here are commonly called "scanners". These are not to be confused with printing machines that employ so-called "scanning" print heads—pens or matrix printing units that move back and forth across the printing medium to create image segments one line or swath at a time.

For purposes of this document, and particularly certain of the appended claims, the phrase "image-related device" is used to mean a printer or scanner.

2. Related Art

Printers which operate by using a scanning print head to mark on a print medium require, first, some provision for regularly keeping track of the head position and speed. Scanners as well, if operating with a movable reading head, have the analogous requirement.

In addition such systems require, at least at certain specific points, some information about the direction in which the head is moving. One reason for this second requirement is that it is a necessary condition for full satisfaction of the first requirement—in other words, for precise positioning information. This relationship will now be explained.

A well-known way to provide the position and speed information is by means of at least one electrooptical sensor that is moved in accordance with the print-head or reading-head movement, and that monitors a so-called "encoder scale". Because plural-sensor systems are more complex and expensive than singe-sensor systems, the present invention is limited to single-sensor systems; however, it is able to do the job of a two-sensor system.

In either a single- or a plural-sensor system, the scale is disposed in correspondence with positions (that is, the full range of positions) of the head across the image-bearing sheet. Such a scale generally takes one of two forms:

(1) a linear strip (often denominated "codestrip") extended—and usually tensioned—across a bed or channel that holds the image-bearing sheet, the strip being directly adjacent and parallel to the print-head or reading-head motion; and (2) a circular, hub-mounted scale read against—for example—the shaft of a motor that drives the print head.

Every such system has some arrangement for initializing the counting of graduations, starting precisely at a well-defined edge of the image area. Counting then continues across that area within a controlled range of speed so that the automatic equipment can, in effect, lock onto the progressively changing position. Once initialized, the system can maintain this lock as long as movement continues in the same direction.

Such a system, however, if operating with a single sensor generally speaking produces substantially identical pulse trains during both directions of movement of the head along its path. Previous workers have recognized that the resulting directional ambiguity is undesirable under certain circumstances—in particular when the moving head reverses direction.

A primary difficulty with such ambiguity is that the system can lose track of position just at—or just before or after—the moment of reversal:

On one hand, if the system reverses while the encoder sensor is reading (or in other words, is "on") a graduation, then the same edge of the graduation is traversed twice: once while entering the graduation while traveling in one direction, and a second time while leaving the same graduation but traveling in the opposite direction.

On the other hand, if the system reverses while the encoder sensor is between graduations, two opposite edges of a graduation are traversed in sequence just before the system reverses—and then the same two edges of the same graduation are traversed again (in opposite order) just after.

The optical sensing system cannot distinguish these two cases.

Thus for example if a graduation is sensed as a dark part of the encoder scale, in the first situation the sensor detects first a light-to-dark transition as the leading edge of the graduation is crossed, and then (after reversal) a dark-to-light transition as the same edge is crossed again. In the second situation too, as the same graduation is traversed twice going in opposite directions, the sensor detects a light-to-dark transition and then a dark-to-light transition as the graduation is passed just before reversal—and then again a light-to-dark and then dark-to-light pair of transitions just after reversal.

Each sequence of light-to-dark and then dark-to-light transition pairs, in this second case, is optically and electrically indistinguishable from the single transition pair in the first case. As a result, when the carriage slows, stops and then starts moving in the reverse direction the system is unable to establish whether the carriage is just leaving a graduation in which it already stopped and reversed, or just leaving a graduation in which it did not quite stop and is now about to stop and reverse—or possibly even just leaving a graduation which it entered immediately after stopping and reversing.

In this way the directional ambiguity in a single-sensor system, if not resolved, would be transformed into a positional ambiguity of at least one graduation. After many reversals a much larger positional ambiguity would accumulate.

It will be understood that for fine positional precision the graduations are spaced very closely, and accordingly each graduation must necessarily be very narrow. The stopping distance and precision of the marking or reading head—for rapid scanning such as called for by high throughput—is not readily made equal to a small fraction of the periodicity of these fine graduations.

Therefore the ambiguity cannot be easily resolved by design adjustment of the relative magnitudes of graduations vs. stopping precision. The general result, for a single-sensor system with no provision for eliminating the ambiguity, would be loss of accurate positional lock, upon reversal of the head.

One well-known way to resolve the ambiguity is to provide not just one but two sensors, both reading the same codestrip but mutually offset along the line of motion by a known distance. In particular it is known in such a so-called "dual-channel encoder" to offset the two sensors by one-quarter of the overall periodicity of the graduations on the encoder scale (or by that distance plus or minus an integral number of periodicities), resulting in two electrical pulse trains in quadrature.

The direction of print-head motion is then ascertainable automatically through comparison of the two pulse trains. Such systems work well but are objectionably expensive in that they require an additional sensor and associated electronics.

U.S. Pat. Nos. 4,786,803 and 4,789,874 of Majette et al. describe representative systems for avoiding these costs, while nevertheless resolving the ambiguity, in a single-channel encoder. Majette et al. accomplish these goals, in a scanning-head printer, by providing special features on the encoder scale—but not within the range of operation in which the print head produces markings on the print medium.

These special features define the edges of that range of operation, and define positions at which the print head should reverse direction, and also define a position at which the print head should be parked. The positions designated as defining the extrema of actual marking by the print head are called "print limits", and those designated for change of direction are called "sweep limits" and sometimes "turn-around points"—or just "turn-arounds" (although the head ordinarily is not actually reoriented for the reverse motion).

These features which define the print limits, sweep limits, and parking location on the Majette et al. encoder scale are graduations similar to but distinguished from the position-and-velocity graduations. The limit and parking-location graduations are distinguished by being wider than the position-and-velocity graduations. As Majette et al. explain:

> "The problem presented by the lack of [direction] information in the encoder output signals is handled by superimposing the additional . . . sweep limit bands, in pre-determined spaced positions beyond the print limit bands . . . on the scale." (emphasis added)

Operationally, in terms of firmware that controls movements of a print head, this system depends upon the presence of the print-limit band, at each edge of the print medium, to signal that the next wide band which is reached is a sweep-limit band and so should be used as a reversal or turnaround point. In principle the system can be made to either (1) carry the sensor just past the sweep limit band and then return back through it, or (2) carry the sensor into the sweep limit band and reverse while the sensor is within that band.

Then, after reversal, the associated print limit band is used again for signaling the apparatus to initialize the counting of fine graduations—for the imminent pass across the print medium.

This system is entirely satisfactory for print heads or image-reading heads that operate all the way across the image-bearing sheet before reversing direction. Not all scanning-head systems, however, operate in that fashion.

In particular the limit-band system is not usable in a so-called "logic seeking" system. In such a system the moving head, to save time, reverses when the carriage is only partway across the image-bearing sheet—if the desired image or the image being read has no additional elements to be printed or read in the swath or line where the head is working.

In such a system, in effect, sweep limits (turnaround points) for a given pass of the head may be within rather than beyond the fixed print or read limits, at both ends of each pass. Even at the nominal starting side for each full scan, the head advantageously can be reversed before reaching the nominal image edge if there is no detail to be printed or read near that starting edge.

In some systems the head actually prints or reads while traveling in each of the two directions. In others the head only returns quickly in one of the two directions to a starting position for the next scan.

Logic-seeking is usable in both these types of mechanisms, as well as at both ends of each pass. In particular, even a head that prints or reads unidirectionally must move bidirectionally, and therefore can advantageously be made to reverse before reaching the scan-starting edge, where appropriate.

Such logic-seeking systems necessarily incorporate some means for automatically determining whether image information permits reversal of the carriage when the carriage is only partway across the image-bearing sheet. If so, for a particular line or swath, then these means must also determine exactly where reversal should occur—and should provide in some way for maintaining or renewing position lock at the time of reversal.

In the case of a printing machine, such means most typically preread and evaluate the data to be printed, before beginning each line or swath.

For a scanner, a like function perhaps may be performed by a preview head that only inspects the image quickly to find its extrema and so determine reading limits. Perhaps for special purposes the equivalent function might be accomplished by preprinting an image delimiter element or code at each end of each line or swath of an image that is to be scanned later—and then reversing each reading pass after reading the preprinted delimiter element or code.

In any event, once it has been determined whether the head carriage should reverse when only partway across the image-bearing sheet, reversal can be effectuated accurately—without losing position lock—by a dual-channel encoder, but as explained earlier not by a single-channel encoder such as introduced in the '803 and '874 patents.

Therefore the prior art leaves unsolved the problem of maintaining accurate positional lock at reversals of a marking or reading head, in a logic-seeking system with a single-channel encoder. That is, prior art in image-related devices of the scanning-head type fails to teach any way to enjoy the throughput benefits of logic-seeking in combination with the economic benefits of a single-channel encoder—and accurate positioning.

Accordingly, important aspects of the technology which is used in the field of the invention are amenable to useful refinement.

SUMMARY OF THE DISCLOSURE

The present invention introduces such refinement. The invention has several facets or aspects, which can be used independently—although for best enjoyment of all the advantages of the invention these aspects are preferably used together.

In preferred embodiments of a first of its facets, the present invention is an encoder scale for use in positioning a carriage of an automatic image-related device. More specifically, the scale is for such use in conjunction with use of a visual-image-bearing sheet that has a transverse dimension.

The encoder scale includes a scale substrate corresponding to a distance longer than the transverse dimension of such a visual-image-bearing sheet. The phrase "corresponding to" encompasses both direct correspondence—as for instance when the scale substrate is linear and lies directly along the transverse direction of the sheet, and has a greater length than the dimension of the sheet along that direction—and also indirect correspondence as for instance when the scale substrate is circular and mounted about the hub of a motor shaft that drives a carriage along the transverse direction of the sheet.

The encoder scale also includes some means, associated with the scale substrate, for mounting of the scale to such an image-related device. For purposes of generality and breadth in describing the invention, in some portions of this text and particularly the appended claims these means will be called simply the "mounting means".

The scale also includes some means for automatic reading (or in other words, to be automatically read) by such an automatic image-related device to determine position of such a carriage. These means, also for breadth and generality, will be called the "reading means". The reading means include:

- a first multiplicity of graduations defined along the encoder-scale substrate, and
- a second multiplicity of graduations, also defined along the substrate and interspersed among the first multiplicity of graduations over at least a distance approximately corresponding to the full transverse dimension of such a visual-image-bearing sheet.

The encoder scale also includes some means for automatically distinguishing, by such an automatic image-related device, between the graduations of the first multiplicity and those of the second multiplicity. These means, again for purposes of generality, will be called simply the "distinguishing means".

The distinguishing means include, for each of the second multiplicity of graduations, a feature that is distinctive in relation to the graduations of the first multiplicity.

The foregoing may be a definition or description of the first facet of the invention in its most general or broad form. Even in this broad form, however, this aspect of the invention can be seen to provide the needed refinement which the prior art has failed to provide.

In particular, the second multiplicity or set of graduations provides a basis for establishing turnaround points at many positions across the transverse dimension of the image-bearing sheet. The number of graduations in this second multiplicity can be made large enough, and close enough together (as for instance four graduations per centimeter, ten graduations per inch) to permit head reversal virtually immediately after the last image element to be printed or read in each swath—provided that position is also before the first image element, if any, to be printed or read in the following swath.

Nevertheless these graduations, being interspersed among those of the first multiplicity or set, are spaced further apart from each other than those of the first set. Since the graduations of the second set are spaced further apart, the image-related device can be readily made to reverse its marking or reading head at a point that is clearly and cleanly between two of these graduations.

This enables the apparatus to avoid the positional ambiguity discussed earlier for encoder scales that have only fine graduations. The designer can make certain, in particular, that the head will never stop on a graduation.

With this certainty the apparatus can readily be programmed to proceed on the basis of being able to identify the second-set graduation that will be the first encountered after reversal. For instance the apparatus can be made either to count second-set graduations separately from first-set graduations, or to identify any second-set graduation—whenever desired—on the basis of the previously maintained count of first-set graduations.

Since the graduations of the two sets are mutually distinctive, the use of second-set graduations for control of reversing functions is readily accomplished independently of the graduations in the first set. In particular, after reversal at a position between second-set graduations, the counting of first-set graduations can be reinitialized based on passing one of the second-set graduations.

Although embodiments of the invention in this first aspect thus solve the problems described in the previous section of this document, preferably the first aspect of the invention is practiced in conjunction with certain additional features or characteristics that optimize enjoyment of its benefits.

For example, preferably the scale substrate is a linear strip, and is longer than the transverse dimension of such a visual-image-bearing sheet; and preferably the mounting means are defined in the ends of the linear strip and include means for mounting the strip parallel to a line of motion of such a carriage. In addition, preferably the means for automatic reading comprise means for automatic reading by such an automatic image-related device to determine position of such a carriage along the strip.

It is also preferred that the distinctive feature be a different width—and more specifically that each of the second multiplicity of graduations be wider than each of the first multiplicity.

In preferred embodiments of a second facet or aspect, the invention is an automatic image-related device for use with a piece of visual-image-bearing medium, such as paper, and includes some means for holding a large piece of such medium. For reasons suggested earlier in relation to other means, these will be called the "holding means".

Preferred embodiments of the invention in this second facet also include a carriage, and some means for supporting the carriage—"support means". The carriage and the support means are disposed for travel of the carriage along the support means and across the holding means.

In addition the second aspect of the invention includes one or more image transducers retained on the carriage for interaction with such a piece of visual-image-bearing medium when held in the holding means. By "image transducers" is meant elements for converting image details into signals, or signals into image details as the case may be—or, in other words, for reading or marking on the medium.

Also included in preferred embodiments of the second aspect of the invention are some means for automatically determining the position of the carriage and the image transducers along the support means. These "position-determining means" include four main components, of which the first two are:

an encoder-scale substrate disposed in correspondence with positions of the carriage across the holding means, and some means for automatically sensing position of such a carriage along the support means.

These "sensing means" in turn include these three elements: (1) a first multiplicity of graduations defined along the encoder-scale substrate, (2) a second multiplicity of graduations, also defined along the substrate and interspersed among the first multiplicity of graduations over at least a distance approximately corresponding to the full transverse dimension of such a visual-image-bearing sheet, and (3) some means for detecting the graduations of both multiplicities.

The first two of these elements will be identified very generally as the encoder scale of the first aspect discussed above. The third is part of the rest of the apparatus.

Now continuing with the four main components of the position-determining means, in addition to the encoder scale and the sensing means they include:

some means for automatically distinguishing between the graduations of the first multiplicity and those of the second multiplicity, and means for making positional determinations using the first multiplicity of graduations for a first purpose, and for making positional determinations using the second multiplicity of graduations for a second purpose.

The distinguishing means in turn include these elements: (1) for each of said second multiplicity of graduations, a feature that is distinctive in relation to each of the graduations of said first multiplicity, and (2) some means associated with the detecting means for responding to the distinctive feature.

Preferred embodiments of the second facet of the invention also include some automatic means for effectuating the first and second purposes respectively, based on the positional determinations using the first and second multiplicities of graduations.

The above paragraphs may be a description or definition of the second aspect of the invention in its broadest or most general form, but again even in this form the invention can be seen to provide the desired beneficial combination of positioning accuracy, single-channel-encoder economy, and logic-seeking throughput. These properties of the apparatus follow from the potentialities of the novel encoder scale discussed above in relation to the first aspect of the invention.

Again, however, the invention is preferably practiced in conjunction with certain additional features or characteristics. For instance, preferably the scale is a linear strip and is mounted parallel to the carriage travel along the support means; and the sensing means sense position of the carriage along the strip. Preferably the strip is tensioned parallel to the carriage travel along the support means.

It is also preferable that the holding means comprise two edges; and that the means for making positional determinations include these elements:

first means for using the first multiplicity of graduations for establishing position during carriage motion that starts from an edge of the holding means, and second means for using the second multiplicity of graduations for initializing position establishment during carriage motion that starts between the edges of the holding means.

It is not meant to imply that the first means should be limited to using the first multiplicity of graduations for establishing position during exclusively carriage motion that starts from an edge. To the contrary, it is preferred that the first means also comprise means for establishing position during carriage motion that starts between the edges of the holding means, after initialization by the second means.

In preferred embodiments of a third facet or aspect, the present invention is a method for controlling an automatic image-related device in interaction with a piece of visual-image-bearing medium, such as paper. A device for use in this method has a carriage that travels bidirectionally at least partway across such a medium, driven by a carriage-drive mechanism, and has one or more image transducers retained on the carriage for interaction with such a piece of visual-image-bearing medium, and also has an encoder scale disposed in correspondence with positions of the carriage across such a medium and defining graduations along the encoder scale.

The graduations include first and second mutually distinctive sets of graduations. The second set is interspersed among the first set, over a distance that corresponds with generally the full width of such medium.

The method itself includes these steps:

(a) automatically monitoring the first set of graduations during travel of the carriage across the medium;

(b) automatically controlling the image transducers, based upon the automatic monitoring of the first set of graduations;

(c) automatically maintaining an arrangement for preparing, during travel of the carriage across the medium, to use the positions of the second, distinctive set of graduations interspersed among the first set for reinitialization of counting of the first set of graduations at reversal if reversal is permitted when the carriage is only partway across the medium;

(d) automatically determining whether image information permits reversal of the carriage when the carriage is only Partway across the medium; and (e) in event reversal partway across the medium is permitted, then:

automatically reversing the carriage when the carriage is only partway across the medium, and generally concurrently, reinitializing the automatic monitoring of the first set of graduations, based upon the second set of graduations.

In this description the phrase "maintaining an arrangement for . . . preparing to use" encompasses at least these three methods: (1) counting the second set of graduations as they are passed, (2) being ready to work out from the first-graduation (fine-graduation) count which second-set graduation is to be used, at a time of use, and (3) being ready to hold in memory the count of the first set of graduations as a second-set graduation is passed shortly before reversal. As will be understood, each of these approaches has some relative advantages in terms of firmware simplicity, and all three are workable —and will be further detailed in a later section of this document.

The advantages of this method can be appreciated from the foregoing, even though it may be a definition or description of the third facet or aspect of the invention in its most general or broad form. Nevertheless, preferably the method is practiced with additional steps or characteristics that enhance enjoyment of the advantages of the invention.

Preferably, for example, the automatic monitoring of the first set of graduations includes maintaining a count of the first set of graduations as the carriage passes them; and in event reversal of the carriage is permissible when the carriage is only partway across such medium, then the reversing and reinitializing comprise:

interrupting the automatic monitoring of the first set of graduations after movement of the carriage past a position corresponding to one of the second set of graduations, and discarding the count at or before passing of the carriage past the same position in the opposite direction.

(It is to be understood that the interruption of monitoring of the first set of graduations can occur at any time up to and including the discarding of the count.)

In such a preferred system it is also preferred that the reversing includes using rate of passing said first set of graduations to control reacceleration and velocity of the carriage.

During the transducer-controlling step, it is preferable also to control the carriage-drive mechanism—and to do so based upon the automatic monitoring of the first set of graduations.

In conjunction with the reinitializing step, it is preferable also to control reversal of the carriage-drive mechanism based upon the second set of graduations. This reversal-controlling step or substep also includes controlling the carriage-drive mechanism so that carriage reversal occurs after the monitoring of the second set of graduations has completed detecting one individual graduation of the second set—and has not yet begun detecting an adjacent individual graduation of the second set.

When the image-related device is a printer, and the image transducers are marking elements for forming an image on the medium during multiple passes of travel across the medium, it is also preferred that the image-transducer controlling step include the substeps of:

maintaining data that represents an image whose formation on the medium is desired, and during travel of the carriage across the medium, progressively applying the data to control the marking elements in forming the image on the medium;

and that the automatic carriage-reversal determining step include the substeps of:

analyzing the data to be used in each pass of the carriage across the medium, to determine whether (1) any part of the image in each pass is to be formed after said monitoring of the second set of graduations has finished detecting a final individual graduation of the second set in that pass and before the carriage finishes that pass, and (2) for each pass, any part of the image in the following pass, in the reverse direction, is to be formed before said monitoring of the second set of graduations will detect a first individual graduation of the second set in that following pass, and in event no part of the image in that pass and the following pass is to be so formed, then determining that reversal is permitted when the carriage is only partway across the medium.

If the two sets of graduations are distinctive by virtue of different widths, then it is preferred that the transducer-controlling step include the substep of making allowance for the different width of each graduation of the second set. In this case it is further preferred that the allowance-making step include, in passing each graduation of the second set:

extrapolating a preceding sequence of graduations of the first set; and operating the image transducer in accordance with the extrapolation.

In other words, where a second-set graduation occurs it interrupts the sequence of ticks or sensor responses arising from encounters with first-set graduations; and that sequence—for continuing control purposes—should be simply extrapolated or virtually extended through the position of the second-set graduation.

In the sort of system under discussion it may seem more natural or precise to refer to the insertion of an intermediate pulse or tick between physical features on the encoder scale as interpolation rather than extrapolation. Earlier patent documents in analogous technology, however, have used the term extrapolation—and there is good rationale for it, since as a practical matter the apparatus actually inserts the missing tick based only on the previously encountered ones (rather than basing the insertion in part upon prereading of ticks to be reached later). In view of this rationale, and for the sake of consistency, this document too refers to this insertion as extrapolation.

More-specific procedures for performing the extrapolation may include adaptations of extrapolation procedures such as are described and used in the art for other purposes. For example the earlier-described Majette et al. patents describe producing an electrical waveform that is driven by the pulse train from the encoder system, and that in turn fires the pens.

In the Majette et al. system, the generated waveform has double and quadruple the frequency of the pulse train from the encoder system, and is used to develop images at one hundred twenty or two hundred forty pixels per centimeter. For present purposes the generated waveform could be at the same frequency as the encoder pulses (between mileposts)—or could be at a multiple as for the purposes in Majette.

That form of extrapolation is straightforwardly practiced, and gives good accuracy when the carriage is up to speed and stabilized. In addition it is compatible with the present invention to produce ink-drop precision and accuracy to plus-or-minus one two-hundred-fortieth centimeter (one six-hundredth inch).

This type of extrapolation accordingly can be used to extend the sequence of pen-firing (or scanner-position) pulses through the milepost-graduation positions—whether the number of intermediate pulses to be supplied is just one or is two or four. Alternatively a simpler system could be substituted to generate only one intermediate pulse, at a time after the last previous pulse equal to the timing of the previous period, or an average of several previous periods.

In one way or another the system thus extrapolates from the last of the fine graduations traversed. Basically if the system does not "see" a fine graduation, it fires the pens anyway.

Likewise those skilled in the art will readily perceive how to adapt to present purposes the detailed teachings of Majette et al. with regard to reversal of the carriage at the sweep-limit bands, and reinitialization of the fine-graduation count upon traversing the print-limit bands to reenter the print region.

All of the foregoing operational principles and advantages of the present invention will be more fully appreciated upon consideration of the following detailed description, with reference to the appended drawings, of which:

BRIEF DESCRIPTION OF THE DRAWINGS

FIG. 3 being schematically coordinated with both FIGS. 1 and 1*a*, as suggested particularly by the dashed vertical lines between FIGS. 1 and 3.

DETAILED DESCRIPTION OF THE PREFERRED EMBODIMENTS

Figure 1:
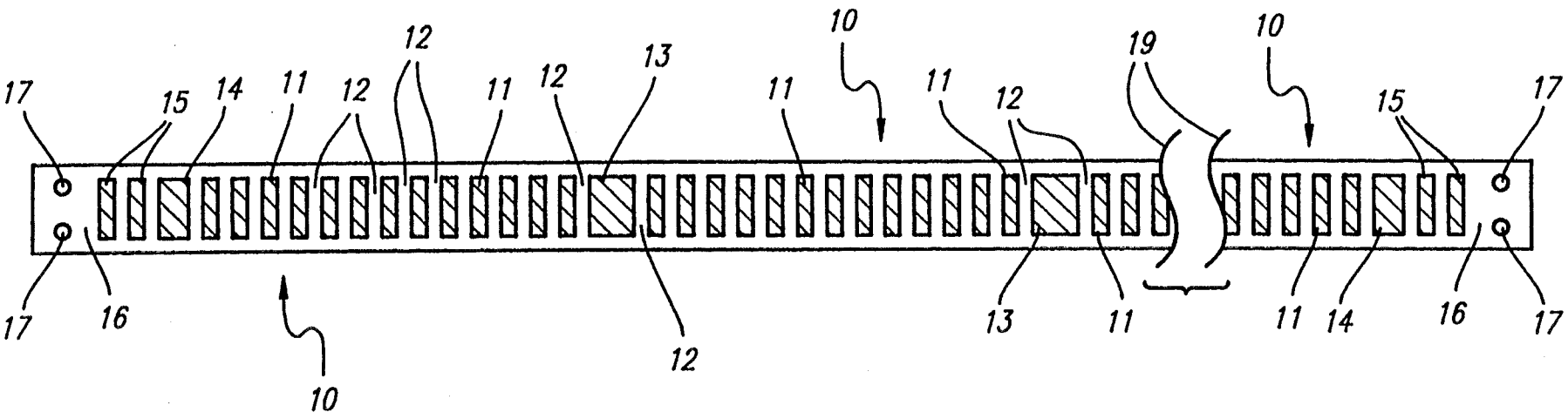
FIG. 1 is a somewhat schematic face-on view (most typically an elevation) of one preferred form of linear encoder scale or encoder strip, or "codestrip", according to the invention.

As shown in FIG. 1, a preferred embodiment of the invention is a linear codestrip 10 having a large multiplicity of fine graduations—that is, very closely spaced and very narrow markings or orifices 11—and a smaller multiplicity of somewhat wider graduations 13 which are spaced or interspersed among the fine graduations 11. The wider ones 13 may be familiarly designated "milepost graduations" or "mileposts".

In this configuration all the spaces 12 between all the graduations 11, 13 are uniform. Print- or read-limit bands 14 may be provided near both ends of the strip, generally as disclosed by Majette et al., and have a distinctive width relative to both the fine graduations 11 and milepost graduations 13; or if preferred these limit bands may be of the same width as the milepost graduations 13.

To aid in defining turnaround zones, additional fine graduations 15 may be provided beyond the print/read-limit bands 14 near each end of the strip, as represented only schematically in the drawing by two such additional graduations 15 at each end; also mounting holes, mounting bosses or other mounting means 17 may be included in each end zone 16, and if desired sweep-limit bands or parking bands (not illustrated), or both, and other features may be included as well.

To permit showing of relative sizes of graduations of different types, FIG. 1 is drawn showing only the two ends of the strip 10, and two initial groupings of fine graduations 11 and mileposts 13 near the left end. FIG. 1 thus omits the greatest part of the length of the strip, which might have, for instance, across a 21¼-centimeter (8½inch) printing zone some eighty-five of the milepost graduations 13.

Figure 2:
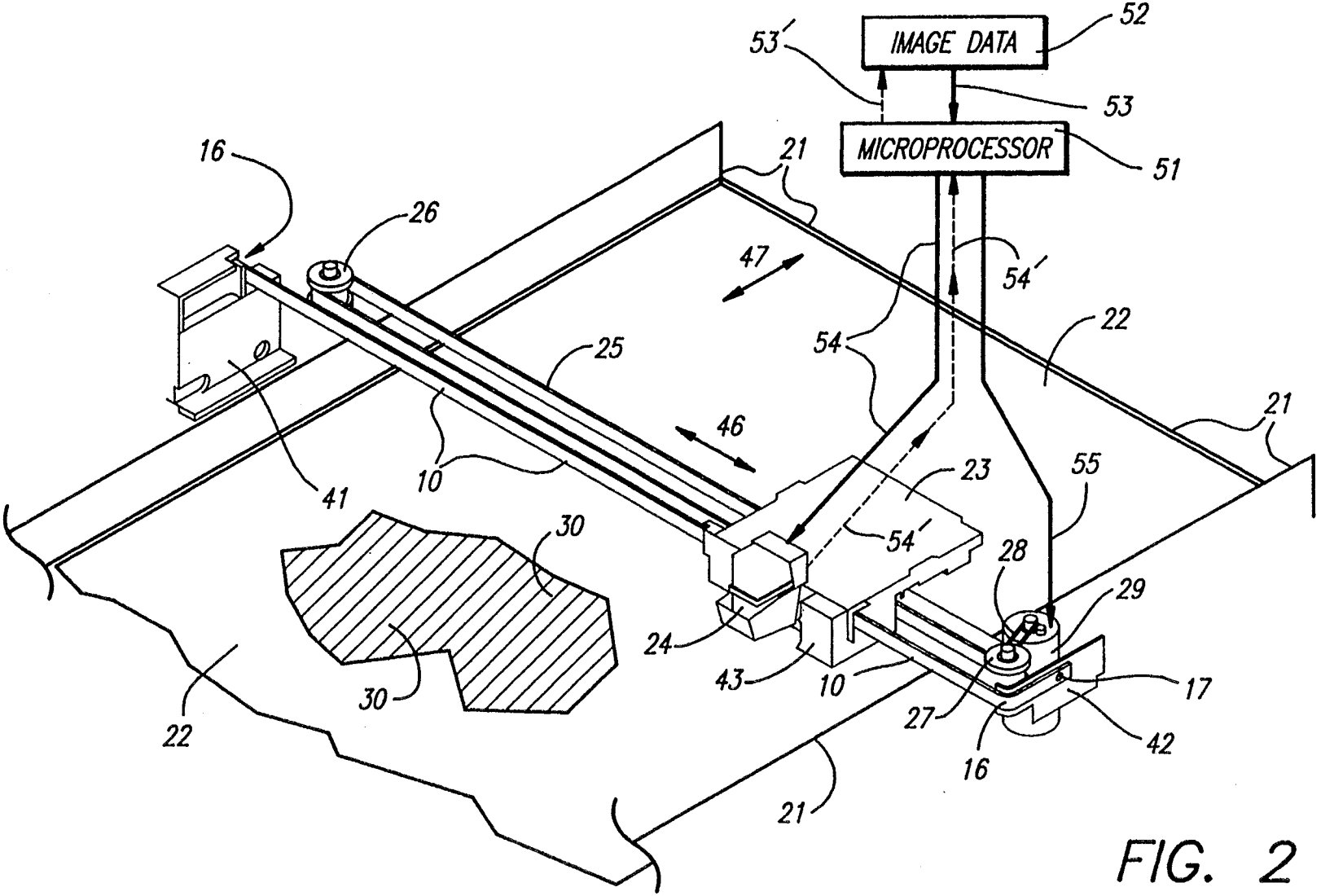
FIG. 2 is a perspective or isometric view, partially schematic, of the FIG. 1 or la encoder scale mounted in a representative image-related device according to the invention.

As FIG. 2 shows, the codestrip 10 is installed in an image-related device transversely across a channel or bed 21 that holds an image-bearing sheet 22. This may be either a blank sheet of printing medium on which an image 30 is to be formed if the image-related device is a printer, or a preprinted sheet from which an image 30 is to be read if the device is a scanner.

The codestrip 10 is fastened and tensioned by its mounting means 17 to stanchions 41, 42 at opposite sides of the bed or channel 21.

Moving parallel to the codestrip 10, on a carriage 23, is a scanning image transducer 24—a printing or reading head—or a plurality of such transducers, which thus operate transversely 46 across the sheet 22. The carriage is driven along one or more guide-and-support rods (not shown) by a belt 25, which in turn is operated about an idler pulley 26 by a drive-transmitting pulley 27; and the latter, through a shorter drive belt 28, by a motor 29.

The sheet 22 may be driven through the channel 21, or carried on the bed 21 as the case may be, orthogonally to the codestrip 10 (and thus to the operation of the carriage 23)—which is to say, longitudinally 47 through the device. Relative motions of the sheet 30 and image transducer or transducers 24 in two orthogonal directions 46, 47 are thus provided.

As shown schematically in FIG. 2, both these motions 46, 47 are controlled 54, 55 by at least one microprocessor 51 in the printer or scanner. In the case of a printer, image data 52 typically input from an external source are supplied 53 to the processor, which then accordingly controls 54 the pen(s) 24 in coordination with the motions 46, 47 to mark the desired image 30 onto the medium 22; in the case of a scanner, image data 54', 53' flow in the opposite direction, these data being first collected 54' by the scanning read head 24 for coordination in the processor 51 with motional information 46, 47 and then forwarded 53' to a data cache 52.

In both cases firmware in or associated with the microprocessor device 51 coordinates the motions 46, 47 with measured position and velocity of the carriage 23, using the codestrip 10 to make the necessary measurements. In particular the fine graduations 11 (FIG. 1) on the strip 10 are used to monitor and thus control velocity and obtain positional information during an actual printing-or-reading mode of operation.

For this purpose a sensor 43 (FIG. 2) rides on the carriage 23 and is trained on the graduations of the strip 10. For best precision and accuracy as FIG. 2 suggests the codestrip 10 and sensor 43 should be very close (in the longitudinal as well as the transverse direction) to the image transducer or transducers 24; to this end the carriage is slotted for extension of the strip 10 through the carriage immediately adjacent to the transducer(s) 24.

The milepost graduations 13 on the strip 10 provide positional information in a form particularly useful in a direction-reversing mode of operation. As indicated earlier, the mileposts 13 are far enough apart to enable the apparatus to halt the carriage reliably between them, but close enough together to enable reversal promptly after the last data in each swath or line—or before the first data in the next swath or line—are read or printed.

In the case of devices that actually read or print bidirectionally (as distinguished from devices that read or print in one direction and merely slew back to the starting point for the next scan) both these conditions must be satisfied at each turnaround. In other words, for bidirectionally reading or printing devices, the system must take into account the data proximity to the margin both at the end of the current scan and the beginning of the next, in determining where to reverse at the end of the current scan; this point will be explained with greater specificity shortly.

The milepost graduations 13 need not be uniformly spaced with respect to each other—since in principle the firmware can include information about the positional distribution of the mileposts 13, or procedures for determining that distribution. Preferably, however, for simplicity's sake and accordingly firmware operating speed the milepost graduations 13 are uniformly spaced.

A preferred spacing is about four mileposts per centimeter (ten per inch). Since for some modern devices the fine graduations 11 are spaced at about sixty or one hundred twenty graduations per centimeter (one hundred fifty or three hundred to the inch), the mileposts 13 accordingly may be interspersed among the fine graduations 11 at about one milepost per fifteen or thirty fine graduation positions respectively. Many other spacings and distributions, however, as will be understood by those skilled in the art, are entirely acceptable and work well.

For one simple kind of operation each milepost 13 may be equal in width to the distance subtended by an integral number of fine graduations 11 and the spaces 12 between (but not to either side of) those graduations 11. For instance, and as shown in FIG. 1, a milepost 13 can preferably equal in width the equivalent of the distance (in portions of the strip marked only with fine graduations) from the leading edge of one fine graduation to the trailing edge of the next.

In this configuration the width of each milepost 13 thus includes the distance across the one space 12 between two such graduations 11. As suggested in FIG. 1, the spaces 12 at each side of each such milepost 13 are the same width as all the other spaces 12 between the fine graduations 11.

If the graduations are formed in that way, the tasks of the firmware in extrapolating through the mileposts are simplified—in particular with no added complexity in selecting the edge of each mark that should be used. More specifically, when the system reaches a milepost 13, if the carriage is not to reverse at that point the firmware simply supplies an additional tick or pulse corresponding to the position midway between—for example—the leading edge of the milepost 13 and the leading edge of the fine graduation 11 following the milepost 13.

Figure 1A:
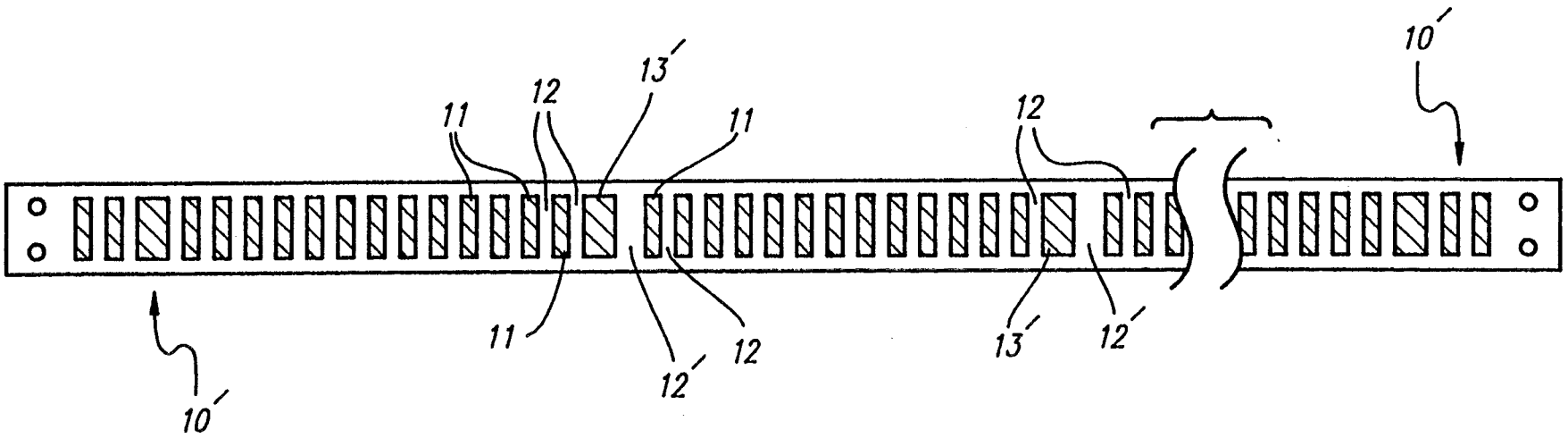
FIG. 1*a* is a like view of another preferred form of codestrip according to the invention.

For another relatively simple form of operation each milepost 13', as shown in FIG. 1*a*, may be equal in width to the distance (in portions of the scale marked only with fine graduations) from the leading edge of one fine graduation 11 to the leading edge of the next. In this case the space 12' just to the right (as drawn) of the milepost 13' is wider—by the width of one fine graduation 11—than all the other spaces 12 between graduations; while the milepost 13' itself, in this case, is correspondingly narrower by the same amount. (Except for the mileposts 13' and right-adjacent spaces 12', all the features of the strip shown in FIG. 1*a* are exactly the same as those in FIG. 1.)

Such a pattern has the advantage that no extrapolation is needed to insert a pulse at the milepost; however, special reading rules are required. In particular, with this configuration positional information for printing or reading, and for velocity control, when scanning from left to right along the strip as drawn in FIG. 1*a*, is derived by triggering on:

- the light-to-dark transitions for fine graduations, and for the leading (left-hand) edge of a milepost graduation 13';
- the dark-to-light transitions for the trailing (right-hand) edge of a milepost 13';

and just the opposite when scanning from right to left. That is, when scanning from right to left the dark-to-light transitions are used for fine graduations, and for the trailing (left-hand) edge of a milepost 13'; and light-to-dark transitions are used for the leading (right-hand) edge of a milepost 13'—so that pens are fired (or image detail positions are determined) on the basis of the same codestrip features during scanning in both directions.

It has been said above that the milepost graduations preferably are positioned every fifteen fine-graduation positions. What this means, in the context of either of the strips shown in FIGS. 1 and 1*a*—since each milepost actually spans two fine-graduation positions—is that the scale has thirteen fine graduations between each adjacent pair of milepost graduations.

(If the graduations are formed in some other ways, for instance by omitting the width of the space between fine graduations in designing the width of a milepost graduation, but then providing the standard spacing before and after the milepost, then the system can still be made to operate but the firmware may become much more complicated. Such needless complexity—in adding or subtracting offsets to account for milepost width that disrupts the fine-graduation spacing sequence before and after the milepost—is preferably avoided by using a simplifying configuration such as the two that are described above and illustrated.)

Reverting to discussion of the codestrip 10 of FIG. 1, which requires extrapolation to provide one missing pulse: the additional extrapolated tick (or ticks) can be used just as the preceding and succeeding ones are conventionally used: to monitor and control the position and velocity of the carriage 23, and to correlate the reading or printing of image data with position. In short, for these purposes the system produces a position pulse—for use in firing pen(s) 24, for instance—whether a graduation edge is there to be read from the encoder scale or not.

For reversal purposes, however, the system treats the mileposts very differently. Midscan reversal (reversal within the limits of the image area, defined for example by print-limit or read-limit bands on the encoder scale) is invoked if prescreening 70 (FIG. 4) of the image data 52 (FIG. 3) to be printed or read—or some special delimiter symbol or code at the edge of the data, in the case of reading—indicates that midscan reversal can be performed without data loss.

In this case the carriage is commanded to pass 91 one milepost graduation (or if preferred some other specific number of mileposts) after the last data bit, and then to stop and reverse 92 before reaching the next milepost. In this maneuver, if the designer wishes, the apparatus can be programmed to count fine graduations to find an ideal place for the turnaround.

Now, however, it is no longer necessary to be accurate about the fine-graduation count, as long as the turnaround occurs at a point that is safely well away from the mileposts before and after. For example, the system can be programmed to aim for a halfway point between mileposts, and if it overshoots or undershoots by one or even three or four fine graduations no harm is done. (In the case of mileposts every fifteen fine graduations, as suggested elsewhere in this document, the halfway point might be, say, the seventh fine graduation after the milepost.)

Once the carriage is tinder way and up to speed, when the sensor reaches a milepost the firmware recognizes it by the absence of one or more pulses at the fine-graduation periodicity—and if desired can establish from the preexisting count which milepost it is, although as will shortly be seen this step is not necessary. The system then uses the preexisting count or the milepost-identification information to reinitialize 95 the fine-graduation count for the following head movement.

In the method of using this apparatus, as noted earlier the image-related device can be a printer, and the image transducers can be marking elements for forming an image on the medium during multiple passes of travel across the medium. In this case the image-transducer controlling step comprises the substeps of maintaining data that represents an image whose formation on the medium is desired; and, during travel of the carriage across the medium, progressively applying the data to control 84 the marking elements in forming the image on the medium.

In this situation the automatic carriage-reversal determining step comprises the substeps of conducting an analysis of the data to be used in each pass of the carriage across the medium, and then based upon that analysis making a decision about carriage reversal. The data analysis involves determining:

(1) which, if any, individual graduation of the second set of graduations will be the first one detected after 73 the final part of the image in that pass is formed, and (2) which, if any, individual graduation of the second set of graduations will be the last one detected before 75 the first part of the image in the following pass, in the reverse direction, is formed.

In other words the analysis involves finding (1) what graduation will be the first one encountered in the present pass, between the last image feature and the margin of the print medium—and (2) what graduation will be the last one encountered in the next pass, between the margin and the first image feature.

Then, if any individual graduation of the second set will be the last detected in the current pass after the final part of the image is formed in the current pass, and if any individual graduation of the second set will be the first detected in the following pass before the first part of the image is formed in that following pass, the apparatus should automatically determine that reversal in the current pass is permitted after both of said first and last detected individual graduations are detected in the current pass.

Another way to say this is that before reversal the apparatus must continue moving in the direction of the present pass, at least until the sensor passes the second of these two controlling graduations—the one which is closer 76 to the margin. If both happen to be equidistant from the margin, then before reversal the apparatus need only pass their common position.

Figure 3:
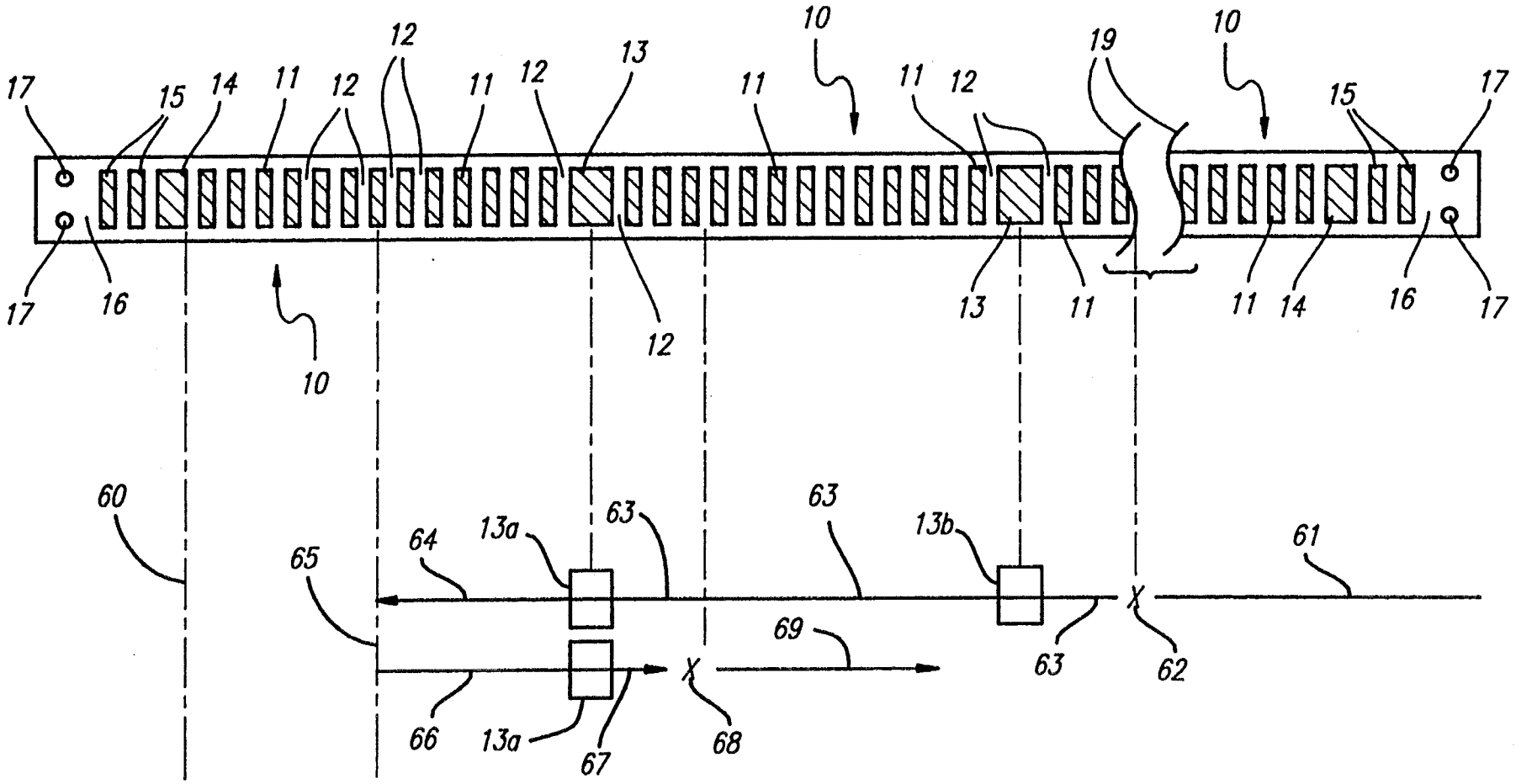
FIG. 3 is a representative diagram of sensor motion along the FIG. 1 or 1*a* codestrip, particularly near a turnaround point.
Figure 4A:
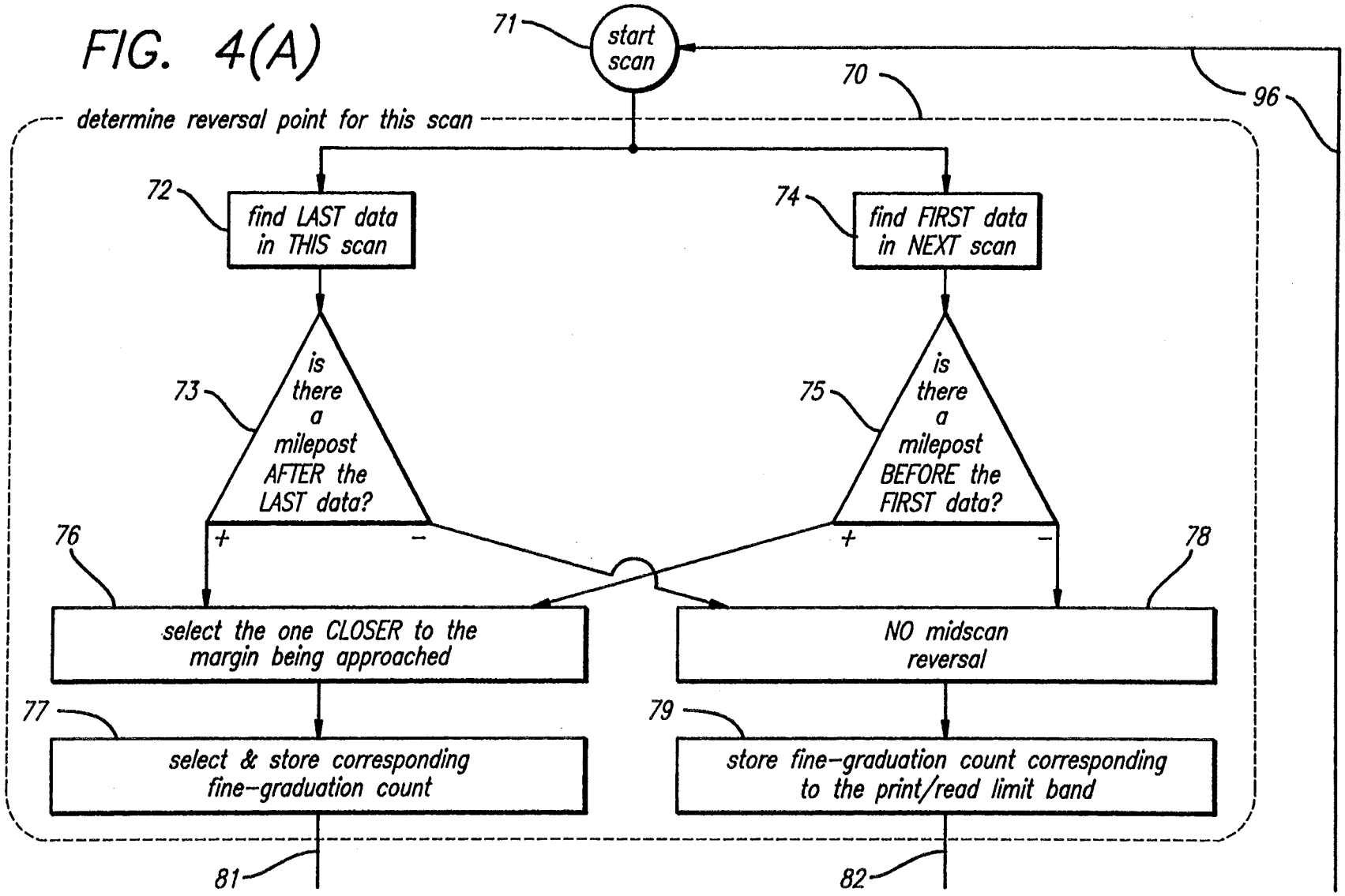
FIG. 4 is a flow chart showing operation of firmware incorporated into the image-related device to control the image transducers in interaction with the FIG. 1 or 1*a* codestrip—or other encoder scale according to the invention.
Figure 4B:
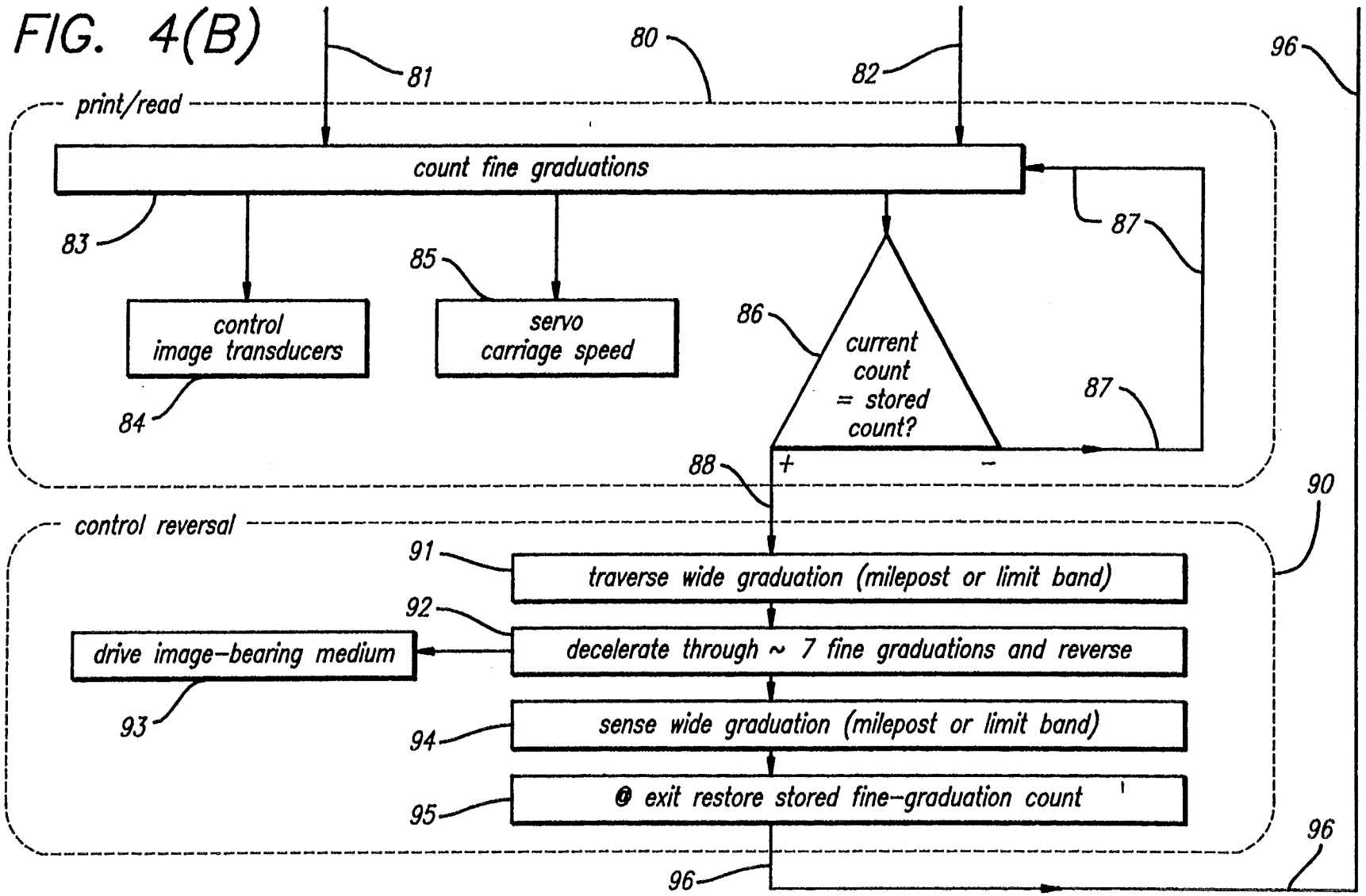

FIG. 3 illustrates the above-described procedure, for a scan from right to left, approaching at 61 the left-hand margin 60. As suggested by dashed vertical lines, the several locations 60–69 identified in this diagram are coordinated with the representation of the codestrip 10 in FIG. 1.

As will be understood, in reality the actual marking or reading transducer is offset along the line of travel from the sensor that reads the codestrip. For purposes of illustration in FIG. 3, however, that offset is ignored and the marking or reading locations are treated as if identical with the corresponding sensor locations.

In FIG. 3 the first identified X-marked position 62 represents the last image feature in the upper pass or swath 61–64. After completing the marking or reading of that feature 62, the image transducer and sensor continue moving 63 to pass the second milepost graduation **13*b* from the margin 60**.

The carriage is not commanded to reverse after that milepost **13*b*, however, since in the next swath there is an image feature at a position 68 which is closer to the margin 60. Accordingly the leftward scan 61–64 continues 64 past the first milepost graduation 13*a*** from the margin.

The scan typically continues 64, 92 in general roughly to a midway point between milepost graduations 13—but in this case to the midway point 65 between the first milepost **13*a* and the print/read-limit band 14, i. e., some seven fine graduations past (to the left of) the first milepost 13*a*. At roughly that midway point 65**, as the carriage executes its reversal, the apparatus can lose position lock with respect to the fine graduations, and in fact for the sake of simplicity can in principle simply discard the count of those graduations.

Such a discarding operation, however, must be managed properly. In particular, it was mentioned above that the system may determine which milepost is in use based upon the count of fine graduations, rather than maintaining a separate count of the milepost graduations. In such an operational mode, before discarding the fine-graduation count it may be desirable that the system perform whatever computations may be needed—for instance, division and rounding—to identify the milepost that has been passed.

In the illustrated example, the last milepost **13*a*** passed before reversal occurred was encountered at the position of virtual fine graduation number fifteen. Dividing by fifteen yields the information that the milepost was number $15/15=1$.

On the other hand, the primary purpose of identifying the milepost **13*a* is to reinitialize the fine-graduation count after that milepost; and for that purpose it is not necessary to identify the milepost, as such, but only to hold in memory 77 (FIG. 4) the fine-graduation count—in this case the number fifteen. Then in the reverse scan 66–69, the first fine graduation reached in the segment 67 after the milepost 13*a* is in fact one higher than fifteen. This reinitialization will thus be carried out by processing that entails only holding 77 the count value (here fifteen), and then restarting 95 the subsequent count at that value as the sensor leaves the milepost 13*a***.

During the preparation for reversal, as the system is to continue, while decelerating, to about the seventh fine graduation beyond the milepost (or in any event about halfway to the next milepost), a fine-graduation count is preferably maintained in some form until deceleration is substantially complete. After that, the fine-graduation count may be discontinued as it is subject to corruption at the point of reversal—as described in the "RELATED ART" section of this document.

Once the actual reversal has occurred, the system recovers—going 66 in the opposite direction—first by using the rate of passing fine graduations (without being concerned about the absolute count) to manage the reacceleration to nominal scanning speed. Then after passing the first milepost 13a the count in the subsequent segment 67 is picked up (or "reinitialized") 95 with the memorized value (here "fifteen") as described above.

Alternatively the process can entail identifying the milepost graduation 13a (for example, here as "milepost number one"). Then the count of fine graduations can be reinitialized on the basis of that identification; for example, here the first fine graduation in the segment 67 will be found as $\#1\times15+1=16$. As will be understood by those skilled in the art, FIG. 4 effectively illustrates this mode of operation too, with appropriate changes of just a few words.

With the carriage now reversed and up to speed, and with its position being counted accurately—and with the image-bearing sheet also advanced longitudinally in the meantime—the system is ready to print or read the first image feature 68 in the new swath, and then continue with subsequent features as at 69 until data analysis again indicates that reversal is in order.

It will thus be understood that in each scan the reversal itself is commanded by the firmware, based upon the data analysis 70. Reacceleration and velocity of the carriage are controlled from a renewed, temporary, count of fine graduations, Thus the milepost graduations are used only to aid in selecting 91 the carriage reversal position as such, and then in resetting 94, 95 the count of fine graduations, It will be understood that the foregoing disclosure is intended to be merely exemplary, and not to limit the scope of the invention—which is to be determined by reference to the appended claims.

What is claimed is:

1. A single-channel encoder scale for use in positioning a carriage of an automatic image related device that has a single-channel sensor, in conjunction with use of a visual-image-bearing sheet that has a transverse usable image dimension; said encoder scale comprising:

a scale substrate corresponding to a distance longer than such transverse usable image dimension of such a visual-image-bearing sheet;

means, associated with the substrate, for mounting of the scale to such an image-related device;

means for automatic reading by such a single-channel sensor of an automatic image-related device to determine position of such a carriage, comprising:

a first multiplicity of graduations defined in a single row along the substrate, and a second multiplicity of graduations, defined in the same row along the substrate and interspersed among the first multiplicity of graduations, in said same row over at least a distance approximately corresponding to such transverse usable image dimension of such visual-image-bearing sheet;

means for enabling such single-channel sensor of such image-related device to automatically distinguish between the graduations of the first multiplicity and those of the second multiplicity; said distinguishing-enabling means comprising, for each of said second multiplicity of graduations, a feature that is distinctive in relation to the graduations of said first multiplicity.

2. The encoder scale of claim 1, wherein:

the scale substrate is a linear strip, and is longer than the transverse dimension of such a visual-image-bearing sheet;

the mounting means are defined in the ends of the linear strip and comprise means for mounting the strip parallel to a line of motion of such a carriage;

the means for automatic reading comprise means for automatic reading by such a single-channel sensor of an automatic image-related device to determine position of such a carriage along the strip.

3. The encoder scale of claim 1, wherein:

said distinctive feature is a different width.

4. The encoder scale of claim 3, wherein:

each of the second multiplicity of graduations is wider than each of the first multiplicity.

5. The encoder scale of claim 1, wherein:

the graduations of said first multiplicity are mutually spaced apart along said row by a first spacing;

the graduations of said second multiplicity are mutually spaced apart along said same row by a second spacing.

6. The encoder scale of claim 5, wherein:

the second spacing is greater than the first spacing.

7. An automatic image-related device for use with a piece of visual-image-bearing medium, such as paper, which medium has a transverse usable image dimension; said device comprising:

means for holding such large piece of medium;

a carriage, and support means for the carriage, said carriage and support means being disposed for travel of the carriage along the support means and across the holding means;

one or more image transducers retained on the carriage for interaction with such piece of visual-image-bearing medium when held in the holding means;

means for automatically determining the position of the carriage and the image transducers along the support means, said position-determining means comprising:

an encoder-scale substrate disposed in correspondence with positions of the carriage across the holding means, means for automatically sensing position of the carriage along the support means; said sensing means including (1) a first multiplicity of graduations defined in a single row along the encoder-scale substrate, (2) a second multiplicity of graduations, also defined in the same single row along the encoder-scale substrate and interspersed among the first multiplicity of graduations over at least a distance approximately corresponding to such transverse usable image dimension of such visual-image-bearing sheet, and (3) single-channel means for detecting the graduations of both multiplicities, means for automatically distinguishing between the graduations of the first multiplicity and those of the second multiplicity; said distinguishing means comprising (1) for each of said second multiplicity of graduations, a feature that is distinctive in relation to each of the graduations of said first multiplicity, and (2) means associated with the single-channel detecting means for responding to the distinctive feature, and means for making positional determinations using the first multiplicity of graduations for a first purpose, and for making positional determinations using the second multiplicity of graduations for a second purpose; and automatic means for effectuating said first and second purposes respectively based on said positional determinations using the first and second multiplicities of graduations.

8. The apparatus of claim 7, wherein:

the scale substrate is a linear strip and is mounted parallel to the carriage travel along the support means;

the single-channel sensing means sense position of the carriage along the strip.

9. The apparatus of claim 7, wherein: the holding means comprise two edges; and the means for making positional determinations comprise:

first means for using the first multiplicity of graduations for establishing position during carriage motion that starts from an edge of the holding means, and second means for using the second multiplicity of graduations for initializing position establishment during carriage motion that starts between the edges of the holding means.

10. The apparatus of claim 9, wherein:

the first means also comprise means for establishing position during carriage motion that starts between the edges of the holding means, after initialization by said second means.

11. A method for controlling an automatic image-related device in interaction with a piece of visual-image-bearing medium, such as paper, which medium has a usable image width; said device having a carriage that travels bidirectionally at least partway across the medium, driven by a carriage-drive mechanism, and having one or more image transducers retained on the carriage for interaction with the piece of visual-image-bearing medium, and having an encoder scale disposed in correspondence with positions of the carriage across the medium and defining graduations in a single row along the encoder scale and having a single-channel sensor for reading all said graduations and in response thereto producing sensor signals; said graduations comprising first and second mutually distinctive sets of graduations together in said single row in common, said second set of graduations being interspersed among said first set within said single row over a distance that corresponds with generally the full usable image width of the medium; said method comprising the steps of:

using the single-channel sensor to automatically monitor the first set of graduations during travel of the carriage across the medium;

automatically controlling the image transducers, based upon said automatic monitoring of the first set of graduations by the single-channel sensor;

automatically maintaining an arrangement for preparing, during travel of the carriage across the medium, to use the positions of the second, distinctive set of graduations interspersed in said same row among the first set for reinitialization of counting of the first set of graduations at reversal if reversal is permitted when the carriage is only partway across the usable image width of the medium;

automatically determining from the single-channel sensor signals whether image information permits reversal of the carriage when the carriage is only partway across the usable image width of the medium; and in event reversal partway across the usable image width of the medium is permitted, then:

automatically reversing the carriage when the carriage is only partway across the usable image width of the medium, and generally concurrently, reinitializing said automatic monitoring of the first set of graduations, based upon the second set of graduations.

12. The method of claim 11, particularly for use with the scale that is a linear strip and is mounted parallel to the carriage travel along the support means; and wherein:

said automatically monitoring step comprises using the single-channel sensor to monitor the first set of graduations during travel of the carriage along the strip; and said automatically determining step comprises determining whether image information permits reversal of the carriage when the carriage is only partway across a portion of the strip that corresponds to the usable image width of the medium.

13. The method of claim 11, wherein:

said automatically monitoring said first set of graduations comprises maintaining a count of single-channel pulses from said single-channel sensor in response to said first set of graduations as the carriage passes them; and in event reversal of the carriage is permissible when the carriage is only partway across the usable image width of the medium, then said reversing and reinitializing comprise:

interrupting said automatic monitoring of the first set of graduations after movement of the carriage past a position along said same row corresponding to one of said second set of graduations, and discarding said count at or before passing of the carriage past the same position in the opposite direction.

14. The method of claim 11, further comprising the step of:

in conjunction with the reinitializing step, also controlling reversal of the carriage-drive mechanism based upon said arrangement-maintaining step.

15. The method of claim 14, wherein the reversal-controlling step comprises:

controlling the carriage-drive mechanism so that carriage reversal occurs after said monitoring of the second set of graduations has completed detecting one individual graduation of the second set, and has not yet begun detecting an adjacent individual graduation of the second set.

16. The method of claim 11, further comprising the steps of:

during the transducer-controlling step, also controlling the carriage-drive mechanism based upon said automatic monitoring of the first set of graduations; and in conjunction with the reinitializing step, also controlling reversal of the carriage-drive mechanism based upon said arrangement-maintaining step.

17. The method of claim 11, particularly for use in controlling an automatic image-related device that is a printer, and in which the image transducers are marking elements for forming an image on the medium during multiple passes of travel across the medium; and wherein:

the image-transducer controlling step comprises the substeps of:

maintaining data that represents an image whose formation on the medium is desired, and during travel of the carriage across the medium, progressively applying the data to control the marking elements in forming the image on the medium; and the automatic carriage-reversal determining step comprises the substeps of:

analyzing the data to be used in each pass of the carriage across the medium, to determine whether (1) any part of the image in each pass is to be formed after said monitoring of the second set of graduations has finished detecting a final individual graduation of the second set in that pass and before the carriage finishes that pass, and (2) for each pass, any part of the image in the following pass, in the reverse direction, is to be formed before said monitoring of the second set of graduations will detect a first individual graduation of the second set in that following pass, and in event no part of the image in that pass and the following pass is to be so formed, then determining that reversal is permitted when the carriage is only partway across the medium.

18. The method of claim 11, particularly for use in controlling an automatic image-related device that is a printer, and in which the image transducers are marking elements for forming an image on the medium during multiple passes of travel across the medium; and wherein:

the image-transducer controlling step comprises the substeps of:

maintaining data that represents an image whose formation on the medium is desired, and during travel of the carriage across the medium, progressively applying the data to control the marking elements in forming the image on the medium; and the automatic carriage-reversal determining step comprises the substeps of:

analyzing the data to be used in each pass of the carriage across the medium, to determine (1) which, if any, individual graduation of the second set of graduations will be the first one detected after the final part of the image in that pass is formed, and (2) which, if any, individual graduation of the second set of graduations will be the last one detected before the first part of the image in the following pass, in the reverse direction, is formed, and if any individual graduation of the second set will be the last detected in the current pass after the final part of the image is formed in the current pass and any individual graduation of the second set will be the first detected in said following pass before the first part of the image is formed in said following pass, then determining that reversal in the current pass is permitted after both of said first and last detected individual graduations are detected in the current pass.

19. The method of claim 11, particularly for use with an image-related device in which the two sets of graduations are distinctive by virtue of different widths; and wherein the transducer-controlling step comprises the substep of:

making allowance for the different width of each graduation of the second set.

20. The method of claim 11, wherein the arrangement-maintaining step is selected from the group consisting of:

(1) counting the second set of graduations as they are passed;

(2) being ready to work out from the first-graduation count the identification of a second-set graduation to be used, at a time of use; and (3) being ready to hold in memory the count of the first set of graduations as a second-set graduation is passed shortly before reversal.

* * * * *